US009476615B2

(12) United States Patent
Park et al.

(10) Patent No.: US 9,476,615 B2
(45) Date of Patent: Oct. 25, 2016

(54) AUTONOMOUS INDUCTION HEAT EXCHANGE METHOD USING PRESSURE DIFFERENCE AND GAS COMPRESSOR AND HEAT PUMP USING THE SAME

(71) Applicant: KOREA BASIC SCIENCE INSTITUTE, Daejeon (KR)

(72) Inventors: Seung Young Park, Daejeon (KR); Yeon Suk Choi, Daejeon (KR)

(73) Assignee: KOREA BASIC SCIENCE INSTITUTE, Daejeon (KR)

( * ) Notice: Subject to any disclaimer, the term of this patent is extended or adjusted under 35 U.S.C. 154(b) by 0 days.

(21) Appl. No.: 14/398,180

(22) PCT Filed: May 30, 2013

(86) PCT No.: PCT/KR2013/004738

§ 371 (c)(1),
(2) Date: Oct. 31, 2014

(87) PCT Pub. No.: WO2014/193000

PCT Pub. Date: Dec. 4, 2014

(65) Prior Publication Data

US 2016/0153685 A1 Jun. 2, 2016

(30) Foreign Application Priority Data

May 28, 2013 (KR) ..... 10-2013-0060342

(51) Int. Cl.
*F04B 41/00* (2006.01)
*F28D 15/02* (2006.01)
(Continued)

(52) U.S. Cl.
CPC ..... *F25B 13/00* (2013.01); *F25B 41/06* (2013.01)

(58) Field of Classification Search
CPC ..... F25B 13/00; F25B 41/06; F25B 23/006; F25B 41/00; F28D 15/00; F28D 15/02; F04B 41/00
USPC ..... 62/238.7, 498, 513; 165/104.25, 165/104.27, 104.32
See application file for complete search history.

(56) References Cited

U.S. PATENT DOCUMENTS 4,748,826 A * 6/1988 Laumen ..... F25B 1/06 417/174
5,259,213 A * 11/1993 Phillippe ..... F25B 13/00 62/160

(Continued)

FOREIGN PATENT DOCUMENTS

JP H11-037596 A 2/1999
JP 2004-270966 9/2004

(Continued)

*Primary Examiner* — Mohammad M Ali
(74) *Attorney, Agent, or Firm* — Adam Warwick Bell; Matthew Rupert Kaser

(57) ABSTRACT

Disclosed herein is an autonomous induction heat exchange method using a pressure difference caused by heat exchange in a single pipeline. In addition, the present invention relates to a gas compressor and a heat pump using the method. The present invention does not require a separate drive device. Therefore, occurrence of vibration or noise can be fundamentally prevented. Consumption of power for compressing gas or heat exchange can be minimized. Furthermore, gas circulates in an autonomous induction manner using a pressure difference. Thus, the length, size and structural shape of a gas compressor or a heat pump can be modified in a variety of ways. Thereby, the present invention can be easily used in different kinds of apparatus and systems and can be easily applied to small heat exchange modules using micro-channels as well as large heat exchange systems.

18 Claims, 22 Drawing Sheets

(51) Int. Cl.

| | |
|---|---|
| ***F25B 41/00*** | (2006.01) |
| ***F25B 13/00*** | (2006.01) |
| ***F25B 41/06*** | (2006.01) |

(56) References Cited

U.S. PATENT DOCUMENTS

| | | | | | |
|---|---|---|---|---|---|
| 5,272,878 | A * | 12/1993 | Schlichtig | F01K 25/08 | 60/649 |
| 5,924,480 | A * | 7/1999 | Arima | F24F 5/0014 | 165/104.25 |
| 5,937,663 | A * | 8/1999 | Chen | F24F 5/0096 | 62/238.7 |
| 6,041,613 | A * | 3/2000 | Morse | F25B 13/00 | 62/238.7 |
| 6,098,414 | A * | 8/2000 | Boxum | B60H 1/00364 | 62/141 |
| 6,318,098 | B1 * | 11/2001 | Boxum | B60H 1/00364 | 62/183 |
| 6,327,994 | B1 * | 12/2001 | Labrador | B01D 61/10 | 114/382 |
| 7,380,588 | B2 * | 6/2008 | Helt | F24D 12/02 | 165/240 |
| 2005/0022963 | A1 * | 2/2005 | Garrabrant | F25B 15/04 | 165/58 |
| 2005/0061027 | A1 * | 3/2005 | Hirakuni | F25B 13/00 | 62/527 |
| 2007/0144186 | A1 * | 6/2007 | Shiflett | C09K 5/047 | 62/112 |

FOREIGN PATENT DOCUMENTS

| | | |
|---|---|---|
| JP | 2008-164237 | 12/2006 |
| KR | 324359 | 4/2002 |
| KR | 337381 | 12/2003 |
| KR | 10-2013-0030700 A | 3/2013 |

* cited by examiner

AUTONOMOUS INDUCTION HEAT EXCHANGE METHOD USING PRESSURE DIFFERENCE AND GAS COMPRESSOR AND HEAT PUMP USING THE SAME

TECHNICAL FIELD

The present invention generally relates to autonomous induction heat exchange methods using pressure differences and gas compressors and heat pumps using the methods. In more detail, the present invention relates to a technique that circulates gas (refrigerant) using a pressure difference caused by heat exchange in a single pipeline, thus making it possible to autonomously circulate gas without using separate power.

Particularly, the present invention relates to an autonomous induction heat exchange method using a pressure difference that is simple in construction and can be structurally modified in a variety of ways so that it can be easily used in different kinds of apparatuses and systems of various fields. For example, the present invention can be easily applied not only to large heat exchange systems but also to small heat exchange modules using micro-channels. In addition, the present invention relates to a gas compressor and a heat pump using the method.

BACKGROUND ART

The present invention pertains to a technique that moves gas from a one point to another point. Furthermore, the present invention includes a technique supplying external fresh gas to a point or resupplying gas that has been moved from another point to the original point.

Generally, to transfer gas (or change the position of the gas), a pressure difference between the original position and a target position is needed. Energy is required to form a pressure difference. Required energy is classified into mechanical energy and thermal energy.

Compressors are a representative example of an apparatus using mechanical energy to transfer gas. Compressors are an apparatus compressing gas and increasing the pressure of gas and are classified into a positive displacement compressor and a dynamic compressor.

The positive displacement compressor uses a cylinder and is mainly used when high output pressure is required. The dynamic compressor uses an impeller and is mainly used when high output flow rate is required.

In such compressors, the amount of drive energy is determined depending on a difference between pressures generated in an inlet end and an outlet end. As a pressure drop in an input part is reduced and a pressure increase in an output part is reduced, consumption of the drive energy is reduced.

To achieve the above purpose, a variety of methods have been introduced. As known to date, although most compressors can be designed such that a large amount of air can be transferred without excessively increasing the pressure of the output part, it is very difficult to reduce a pressure drop in the input part.

Furthermore, because the temperature of gas in the output part is very high, it is required to reduce the temperature of compressed gas so that a larger amount of gas can be stored in a limited space.

Therefore, most existing compressors have very complex structures and are relatively large. In addition, energy consumption is markedly increased because the power required to compress gas is high.

Moreover, there is a problem in that considerable vibration or noise is caused when the cylinder of the positive displacement compressor or the impeller of the dynamic compressor is operated.

In an effort to overcome the above problems, a technique was proposed in Korean Patent Registration No. 10-0416942, entitled "GAS COMPRESSION SYSTEM." This conventional technique is designed to reduce vibration or noise and enhance cooling effects. However, the conventional technique cannot satisfactorily solve the problem of vibration or noise because a rotary compression method using a motor is used. Moreover, the problems of a complex structure and large size remain.

Meanwhile, compressors provided in refrigerators or the like use refrigerant to reduce the temperature in the refrigerators. That is, the compressors are used for heat transfer.

However, such a compressor also has a problem of vibration or noise being caused by the operation of a motor of the compressor.

Heat pipes are an example of the technique using thermal energy to transfer gas. The heat pipes do not require a separate drive device and are able to transfer heat only using their own structural characteristics.

However, heat pipes are problematic because there are many limitations in determining the length and the internal shape and configuration thereof due to the structural characteristics required for heat transfer. Consequently, conventional heat pipes can be used only in specific fields or products.

DISCLOSURE

Please note that all documents referenced herein are incorporated by reference for all purposes.

Technical Problem

As stated above, although the conventional compressors use mechanical power and are able to output a high flow rate or extra-high pressure, high drive energy is required because the pressure of the input part is low and the pressure of the output part is high. Furthermore, significant noise or vibration is caused, and increasing the lifetime and the maintenance cycle of the compressors is limited.

Accordingly, the present invention has been made keeping in mind the above problems occurring in the prior art, and an object of the present invention is to provide an autonomous induction heat exchange method using a pressure difference that does not requires a separate drive device and makes it possible to modify the length, size and structural shape of an apparatus using the method in a variety of ways, and to provide a gas compressor and a heat pump using the method.

Another object of the present invention is to provide an autonomous induction heat exchange method that uses a pressure difference caused by heat exchange in a single pipeline in such a way that the pressure of an input part is increased while the pressure of an output part is reduced, thus circulating gas in an autonomous drive manner without using separate power, and to provide a gas compressor and a heat pump using the method.

A further object of the present invention is to provide an autonomous induction heat exchange method using a pressure difference in which an apparatus using the method can be simple in construction and be structurally modified in a variety of ways, whereby the method can be used in different kinds of apparatuses or systems of various fields. For example, the present invention can be easily applied to small heat exchange modules using micro-channels as well as large heat exchange systems, and can also provide a gas compressor and a heat pump using the method.

Technical Solution

In order to accomplish the above objects, in an aspect, the present invention provides an autonomous induction heat exchange method using a pressure difference, including: a heat absorption operation of absorbing heat energy generated from a heat source of a heat source part; a temperature and pressure increase operation of applying the heat energy of the heat source part to low-temperature gas and producing high-temperature and high-pressure gas; a discharge gas supply operation of discharging the high-temperature and high-pressure gas using a pressure difference and supplying the high-temperature and high-pressure gas to a compression unit; a temperature and pressure reduction operation of conducting heat exchange in the compression unit and converting the high-temperature and high-pressure discharge gas into low-temperature and low-pressure discharge gas; a gas intake operation of drawing suction gas into the heat source part using a pressure difference, the suction gas having been increased in temperature and pressure by heat exchange with the discharge gas in the temperature and pressure reduction operation; and a gas suction operation of suctioning and adding gas of an amount corresponding to a volume reduced by the suction gas drawn into the heat source part.

The low-temperature and low-pressure discharge gas produced in the temperature and pressure reduction operation may be drawn as the suction gas into the heat source part through the gas suction operation and the gas intake operation.

The autonomous induction heat exchange method may further include, after the temperature and pressure reduction operation, a gas compression operation of accumulating low-temperature and low-pressure discharge gas that has passed through the heat exchange process in the compression unit and producing low-temperature and high-pressure gas. The gas suction operation may include suctioning and adding low-temperature gas drawn from the outside.

In the heat absorption operation through the gas supply operation, a suction valve of the heat source part may controlled to be closed, and a discharge valve of the heat source part may be controlled to be open. In the temperature and pressure reduction operation and the gas intake operation, the discharge valve of the heat source part may be controlled to be closed, and the suction valve of the heat source part may be controlled to be open.

In the heat absorption operation and the temperature and pressure increase operation, the suction valve and the discharge valve of the heat source part may be controlled to be closed. In the gas supply operation, the discharge valve of the heat source part may be controlled to be open. In the temperature and pressure reduction operation, the discharge valve of the heat source part may be controlled to be closed. In the gas intake operation, the suction valve of the heat source part may be controlled to be open.

In at least one of the heat absorption operation and the discharge gas supply operation, a heater may be operated to supply heat to the heat source part. In the gas intake operation, the operation of the heater may be interrupted.

In an aspect, the present invention provides a gas compressor using an autonomous induction heat exchange method using a pressure difference. The gas compressor includes: a heating chamber supplying heat energy to low-temperature gas and producing high-temperature and high-pressure gas whereby the interior of the heating chamber enters a high-pressure state, wherein when the heating chamber discharges the high-temperature and high-pressure, the interior of the heating chamber enters a low-pressure state; an intake pipe drawing the low-temperature gas into the heating chamber in an autonomous induction manner using a pressure difference while the interior of the heating chamber is in the low-pressure state; and a supply pipe supplying high-temperature and high-pressure gas produced in the heating chamber to the outside in an autonomous induction manner using a pressure difference while the interior of the heating chamber is in the high-pressure state. Heat may be exchanged between a first heat exchange part formed in at least a portion of the intake pipe and a second heat exchange part formed on at least a portion of the supply pipe.

The gas compressor may further include a cooler provided in a predetermined portion of the first heat exchange part. The cooler cools the interior of the first heat exchange part. When the first heat exchange part enters a positive pressure state and the second heat exchange part enters a negative pressure state by heat exchange between the first heat exchange part and the second heat exchange part, gas in the first heat exchange part may be drawn into the heating chamber by a pressure difference between both ends of the heating chamber. When the gas in the first heat exchange part is drawn into the heating chamber, the cooler may be operated to cool the interior of the first heat exchange part. When the interior of the first heat exchange part is cooled and enters a negative pressure state, external gas may be drawn into the first heat exchange part.

The gas compressor may further include: a first valve provided between the heating chamber and the intake pipe; and a second valve provided between the heating chamber and the supply pipe. When the first valve is closed and the second valve is opened so that the high-temperature and high-pressure gas produced in the heating chamber is moved to the second heat exchange part, heat may be exchanged between low-temperature gas remaining in the first heat exchange part and the high-temperature and high-pressure gas.

When the second valve is closed and the first valve is opened, middle-temperature gas produced by heat exchange between the low-temperature gas and the high-temperature and high-pressure gas in the first heat exchange part may be drawn into the heating chamber.

The gas compressor may further include a cooler provided in a predetermined portion of the first heat exchange part. The cooler cools the interior of the first heat exchange part. When the middle-temperature gas is drawn into the heating chamber, the cooler may be operated to cool the interior of the first heat exchange part. During a time for which external gas of an amount corresponding to an amount of gas drawn into the heating chamber is charged into the first heat exchange part, the first valve and the second valve may be maintained in a closed state.

Heat may be exchanged between a third heat exchange part formed in at least a portion of the intake pipe between the heating chamber and the first heat exchange part and a fourth heat exchange part formed in at least a portion of the intake pipe extending from the first heat exchange part to the outside.

At least one of the first heat exchange part and the fourth heat exchange part may form a multiple pipe structure such that gas flows therein in a zigzag manner.

The first heat exchange part and the second heat exchange part may respectively comprise a plurality of first heat exchange parts and a plurality of second heat exchange parts.

At least one of the first heat exchange parts may form a multiple pipe structure such that gas flows therein in a zigzag manner.

In a further aspect, the present invention provides a heat pump using an autonomous induction heat exchange method using a pressure difference, the heat pump including: a heat absorption pipe absorbing heat energy from a heat source; an exhaust pipe through which refrigerant absorbing heat energy in the heat absorption pipe is moved to a radiator in an autonomous induction manner by a difference between a heat absorption pipe side pressure and a radiator side pressure; an intake pipe through which refrigerant cooled by discharge of heat energy from the radiator is drawn into the heat absorption pipe in an autonomous induction manner by a difference between a radiator side pressure and a heat absorption pipe side pressure; and a heat exchange part formed in at least a portion of the exhaust pipe and the intake pipe, the heat exchange part conducting heat exchange.

The heat exchange part may include a first multiple heat exchange pipe having a multiple pipe structure such that: a central portion thereof is spatially connected to a portion of the exhaust pipe adjacent to the heat absorption pipe; a peripheral portion thereof is spatially connected to a portion of the intake pipe adjacent to the radiator; and a space is formed in a zigzag manner between the central portion and the peripheral portion of the first multiple heat exchange pipe. The heat exchange part may further include a second multiple heat exchange pipe having a multiple pipe structure such that: a central portion thereof is spatially connected to a portion of the intake pipe adjacent to the heat absorption pipe; a peripheral portion thereof is spatially connected to the first multiple heat exchange pipe; and a space is formed in a zigzag manner between the central portion and the peripheral portion of the second multiple heat exchange pipe. Refrigerant cooled in the radiator may flow into the peripheral portion of the second multiple heat exchange pipe via the peripheral portion of the first multiple heat exchange pipe, flow into the first multiple heat exchange pipe after passing through a heat exchange process in the second multiple heat exchange pipe, and then flow into the heat absorption pipe via the central portion of the second multiple heat exchange pipe after passing through a heat exchange process in the first multiple heat exchange pipe.

The heat absorption pipe, the exhaust pipe, the intake pipe and the heat exchange part may respectively comprise a plurality of heat absorption pipes, a plurality of exhaust pipes, a plurality of intake pipes and a plurality of heat exchange parts. The heat absorption pipes may be disposed around the heat source at positions adjacent to each other. The exhaust pipes, the intake pipes and the heat exchange parts may be symmetrically arranged around the heat source. The heat absorption pipes, the exhaust pipes, the intake pipes and the heat exchange parts may be connected to each other to form a single pipeline.

Advantageous Effects

The present invention does not require a separate drive device. Therefore, vibration or noise can be fundamentally prevented and the consumption of power (electric energy) for compressing gas or heat exchange can be minimized.

Furthermore, the present invention can circulate gas in an autonomous induction manner using a pressure difference. Thus, the length, size and structural shape of a gas compressor or a heat pump can be modified in a variety of ways.

Thereby, the present invention can be easily used in different kinds of apparatus and systems and can be easily applied to small heat exchange modules using micro-channels as well as large heat exchange systems.

Particularly, the present invention can compress gas using waste heat making operation possible even without a separate heater.

BEST MODE

Hereinafter, preferred embodiments of an autonomous induction heat exchange method using a pressure difference, and a gas compressor and a heat pump using the same according to the present invention will be described in detail with reference to the attached drawings.

Figure 1:
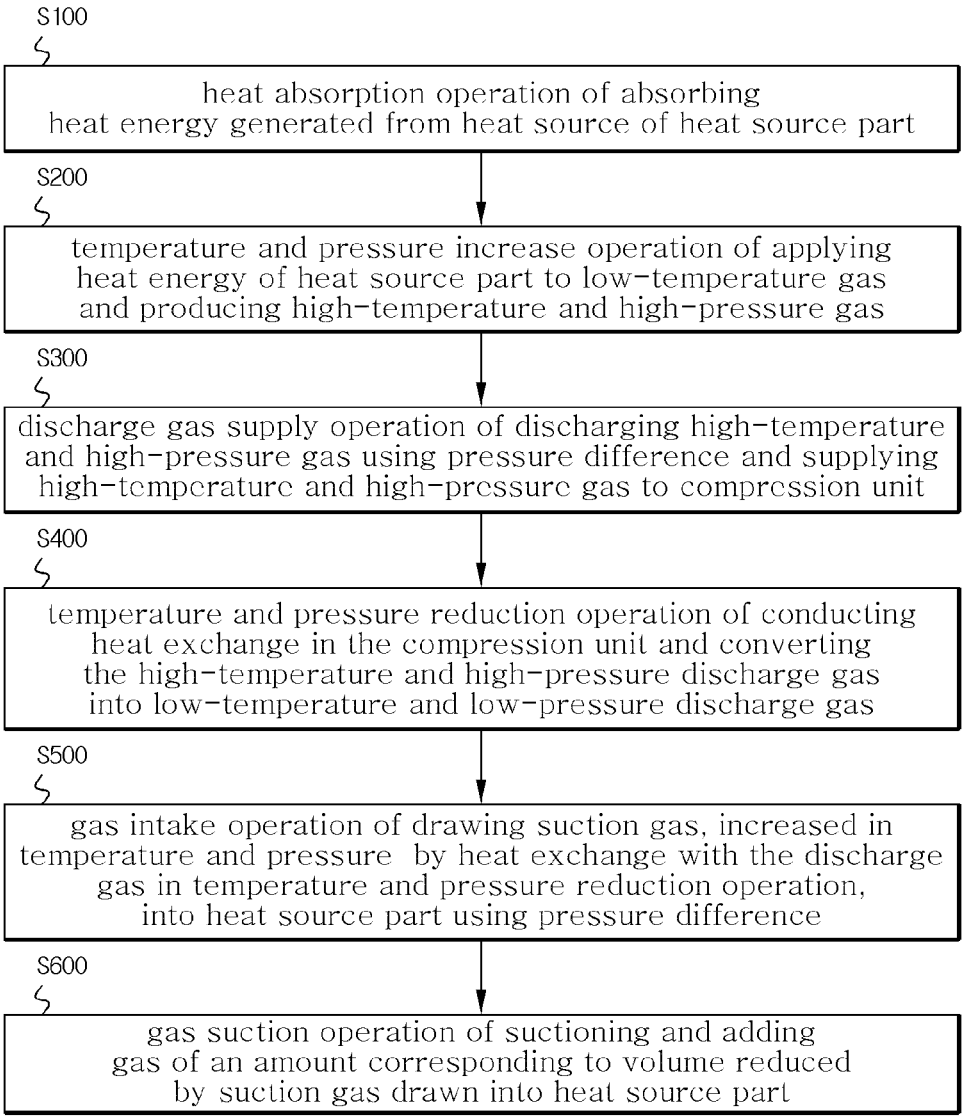
FIG. 1 is a flowchart showing an embodiment of an autonomous induction heat exchange method using a pressure difference according to the present invention.
Figure 3:
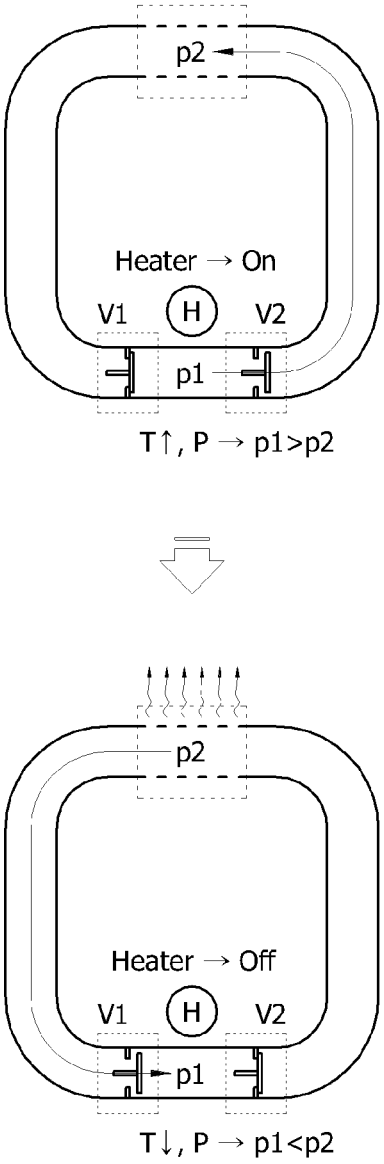
FIG. 3 is a view illustrating the principle of the autonomous induction heat exchange method using a pressure difference.

FIG. 1 is a flowchart showing an embodiment of an autonomous induction heat exchange method using a pressure difference according to the present invention. FIG. 3 is a view illustrating the principle of the autonomous induction heat exchange method using a pressure difference. Hereinafter, the embodiment of FIG. 1 will be explained with reference to FIG. 3.

Referring to FIG. 3, in operation S100, when absorbing heat energy generated from a heat source H of a heat source part p1, gas in the heat source part p1 increases in temperature T, and the pressure P thereof also increases.

In other words, low-temperature gas in the heat source part p1 is converted into high-temperature and high-pressure gas by heat energy, in operation S200.

As shown in an upper portion of FIG. 3, in operation S300, high-temperature and high-pressure gas produced in the heat source part p1 is discharged from the heat source part p1 and supplied to a compression unit p2 by a pressure difference (p1>p2) between the heat source part p1 and the compression unit p2. Here, the compression unit p2 refers to a gas compressor for compressing gas. For a heat pump, the compression unit p2 refers to a radiator.

Moved to the compression unit p2, high-temperature and high-pressure gas (discharge gas) is converted in operation S400 into low-temperature and low-pressure gas by heat exchange in the compression unit p2. In a gas compressor, low-temperature and low-pressure gas that has passed through the heat exchange process can be changed into low-temperature and high-temperature gas in the compression unit p2.

Meanwhile, as shown in the upper portion of FIG. 3, because gas that has been in the heat source part p1 is moved to the compression unit p2, the pressure in the heat source part p1 is reduced.

In operation S500, low-temperature gas (suction gas to be drawn into the heat source part) that receives heat from high-temperature and high-pressure discharge gas at the temperature and pressure reduction operation S400 is increased in pressure by heat exchange to a pressure higher than the pressure in the heat source part p1 and then drawn into the heat source part p1 by a pressure difference.

In operation S600, an amount of gas corresponding to the volume reduced by the suction gas drawn into the heat source part P1 is suctioned to supplement the gas. The drawn gas for replenishment may be low-temperature gas supplied from the outside or low-temperature gas that is supplied from the compression unit p2 after having passed through a heat exchange process.

As shown in the lower portion of FIG. 3, low-temperature gas supplied from the outside (for the gas compressor) or from the compression unit p2 (for the heat pump) is drawn into the heat source part p1 by a pressure difference.

For the gas compressor, the heat absorption operation S100 to the gas suction operation S600 are repeated to compress gas in the compression unit p2.

For the heat pump, the heat absorption operation S100 and the gas suction operation S600 are repeated to circulate gas and refrigerant in a closed loop (in operation S600). In other words, low-temperature and low-pressure discharge gas produced at the temperature and pressure reduction operation S400 is drawn as suction gas into the heat source part after passing through the gas suction operation S600 and the gas intake operation S500.

In the heat absorption operation S100 to the gas suction operation S600, a suction valve V1 and a discharge valve V2 may be controlled in a manner shown in FIG. 3 so as to increase a pressure difference in the internal gas and make movement of the gas more efficient.

For example, for an apparatus requiring low-speed gas compression or heat exchange, the heat absorption operation S100 to the gas supply operation S300 are conducted while the suction valve V1 of the heat source part p1 is closed and the discharge valve V2 of the heat source part p1 is opened. The temperature reduction operation S400 and the gas intake operation S500 are conducted while the discharge valve V2 of the heat source part p1 is closed and the suction valve V1 of the heat source part p1 is opened.

As such, if each operation is conducted while one of the valves is open, a pressure difference in internal gas between areas is relatively reduced compared to that of the following method. Therefore, the gas compressor or the heat pump according to the present invention can be operated without noise.

For an apparatus requiring high-speed gas compression or heat exchange, in the heat absorption operation S100 and the temperature and pressure increase operation S200, the suction valve V1 and the discharge valve V2 of the heat source part p1 are controlled to be closed. In the gas supply operation S300, the discharge valve V2 of the heat source part p1 is controlled to be open. In the temperature reduction operation S400, the discharge valve V2 of the heat source part p1 is controlled to be closed. In the gas intake operation S500, the suction valve V1 of the heat source part p1 is controlled to be open.

Accordingly, in each operation, a pressure difference in internal gas between areas can be comparatively increased.

As stated above, if in each operation the suction valve V1 and the discharge valve V2 are controlled, the performance of the gas compressor or the heat pump according to the present invention can be enhanced, and they can be operated with reduced noise.

Although the terms "discharge gas" and "suction gas" have been defined based on the flow direction of gas relative to the heat source part P1, the term "discharge" may be changed into the term "exhaust" or "supply" and the term "suction" may be changed into the term "intake" depending on circumstances in the following description of the gas compressor or the heat pump.

Figure 2:
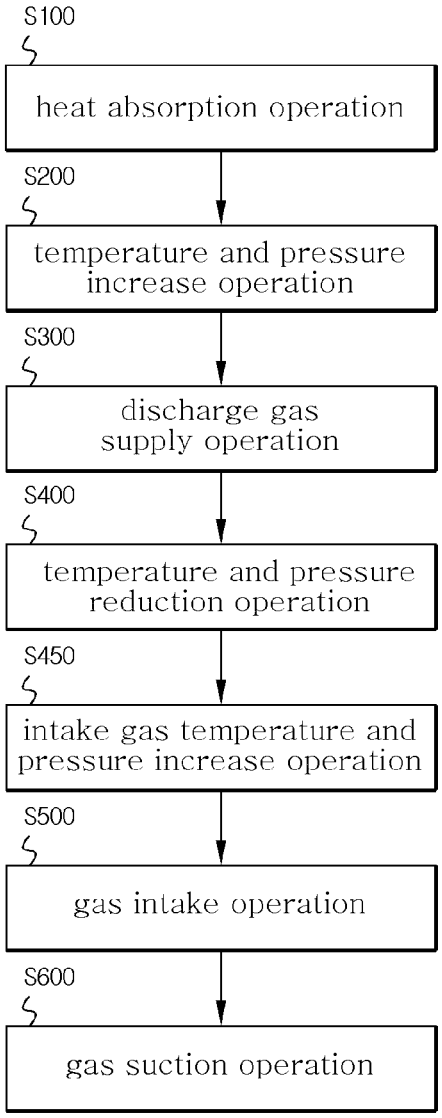
FIG. 2 is a flowchart showing another embodiment of the heat exchange method of FIG. 1.
Figure 4:
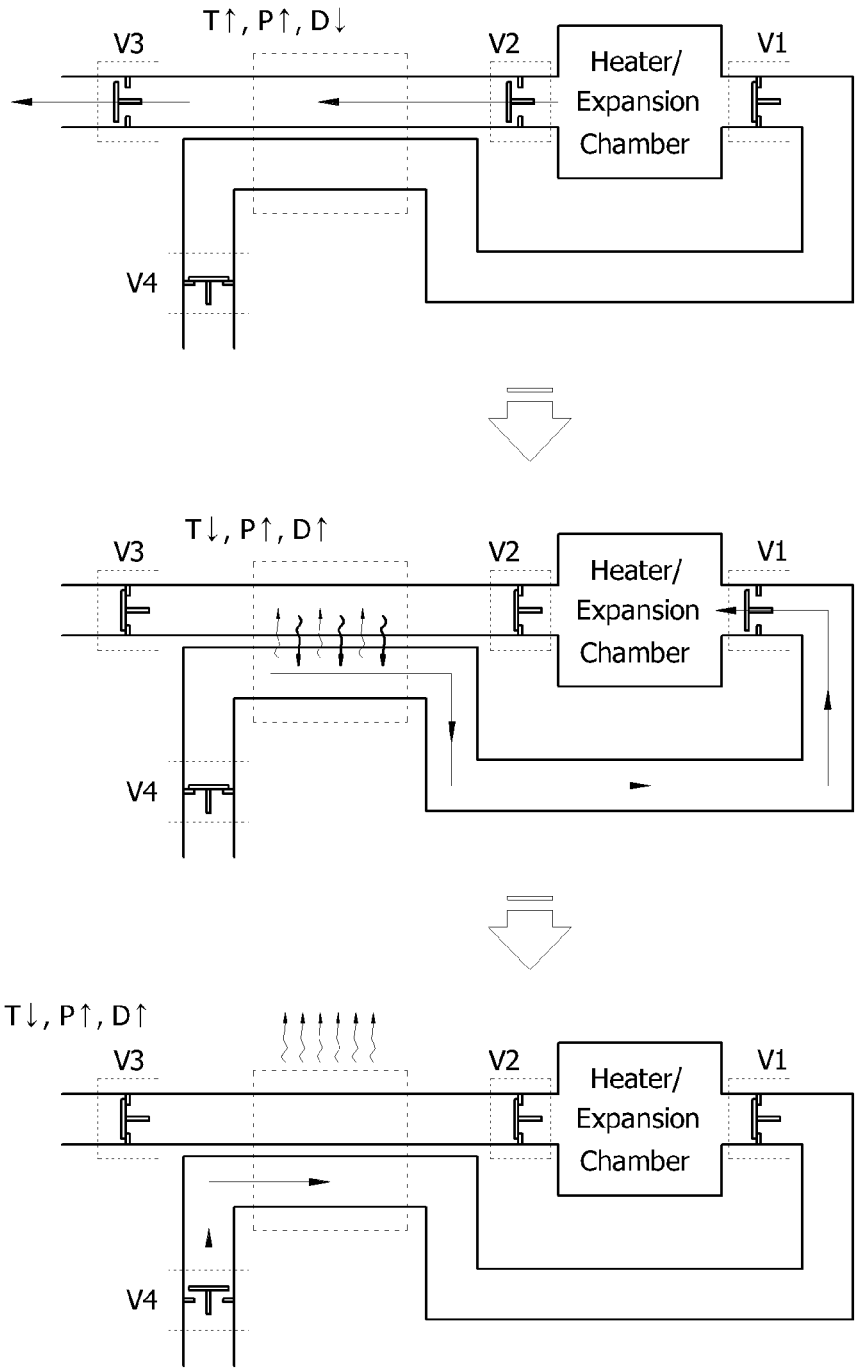
FIG. 4 is a view illustrating the operational principle of a gas compressor using the autonomous induction heat exchange method of FIG. 3.

FIG. 2 is a flowchart showing another embodiment of the heat exchange method of FIG. 1. FIG. 4 is a view illustrating the operational principle of a gas compressor using the autonomous induction heat exchange method of FIG. 3. Hereinafter, FIG. 2 will be explained with reference to FIG. 4.

Referring to FIG. 2, when a heater shown in FIG. 4 is operated in operation S100, gas in an expansion chamber is converted into high-temperature and high-pressure gas in operation S200, and a discharge valve V2 opens so that the high-temperature and high-pressure gas can be moved to a heat exchange part (designated by a dotted-line of FIG. 4), as shown in an upper portion of FIG. 4, in operation S300.

High-temperature and high-pressure gas moved to an exhaust pipe of the heat exchange (an upper pipe of the heat exchange part of FIG. 4) gives heat to low-temperature gas drawn into an intake pipe of the heat exchange (a lower pipe of the heat exchange of FIG. 4), as shown in an intermediate portion of FIG. 4, and then is converted into low-temperature and low-pressure gas in operation S400. Low-temperature gas drawn from the outside is converted into middle-temperature gas by the heat exchange and is thus increased in pressure in operation S450. Thereafter, in operation S500, while an intake valve V4 is closed and a suction valve V1 is opened, the low-temperature gas is drawn into the expansion chamber.

As such, after low-temperature gas is changed into middle-temperature gas by heat exchange, it is increased in pressure and is supplied into the expansion chamber that is in a low-pressure state. Therefore, the effect of pushing gas toward the expansion chamber can be obtained. Consumption of energy required to heat gas in the expansion chamber can be minimized because gas heated to a middle temperature is supplied to the expansion chamber.

High-temperature and high-pressure gas that has been heated in the expansion chamber and moved to the heat exchange part is converted into low-temperature gas after passing through a heat exchange process and is also reduced in pressure. Thus, an effect of pulling gas from the expansion chamber can be obtained. As such, the effect of pushing gas into the expansion chamber and the effect of pulling gas therefrom are alternately and repeatedly obtained. In this way, a pull-push or push-pull function is conducted, so that gas in the expansion chamber can be effectively purged.

Furthermore, the suction valve V1 opens as a result of an increase in pressure due to conversion from low-temperature into middle-temperature gas in the heat exchange part, and the middle-temperature gas increased in pressure is thus drawn into the expansion chamber. Consequently, the pressure in the heat exchange part is reduced.

Subsequently, in operation S600, when the heat exchange part gives heat to the outside and the temperature in the heat exchange part is reduced, middle-temperature gas in the heat exchange part is also reduced in temperature, and the pressure thereof is also reduced. Therefore, if the intake valve V4 opens while the suction valve V1 and the discharge valve V2 are closed, external air can be suctioned into the intake pipe of the heat exchange part. Here, when the discharge valve V2 is in an open state, heat is supplied to the intake pipe of the heat exchange part, whereby it may be difficult for external air to be drawn into the intake pipe of the heat exchange part. Given this, it is preferable that the discharge valve V2 be maintained in a closed state.

The heat exchange part functions to conduct the five cycles listed below. First, the heat exchange part can receive high-temperature and high-pressure gas discharged from the expansion chamber. Second, the heat exchange part can reduce the pressure of the high-temperature and high-pressure gas through a heat exchange process in which high-temperature heat energy is transferred from the discharged high-temperature and high-pressure gas to low-temperature gas. Third, the heat exchange part can increase the temperature and pressure of drawn low-temperature gas and supply it to the expansion chamber using a pressure difference. Fourth, the temperature and pressure of gas drawn into the heat exchange part can be reduced by a heat dissipation function of the outer surface of the heat exchange part. Fifth, the heat exchange part suctions an amount of gas corresponding to the pressure reduced in the fourth step so as to supplement the reduced volume of gas before supplying gas to the expansion chamber.

The heat exchange part introduced in the present invention is a heat exchanger having an improved function of conducting the above-mentioned five cycles. The heat exchanger according to the present invention is not only markedly different from the conventional heat exchanger that conducts only heat exchange between a high-temperature medium and a low-temperature medium but also is able to reduce noise by virtue of the autonomous induction operation and has improved effects in terms of performance.

Hitherto, the autonomous induction heat exchange method using a pressure difference and the gas compression method using the same according to the present invention have been illustrated. Hereinafter, the structural characteristics of a gas compressor and a heat pump using the principles of the above-mentioned methods will be described.

Figure 5:
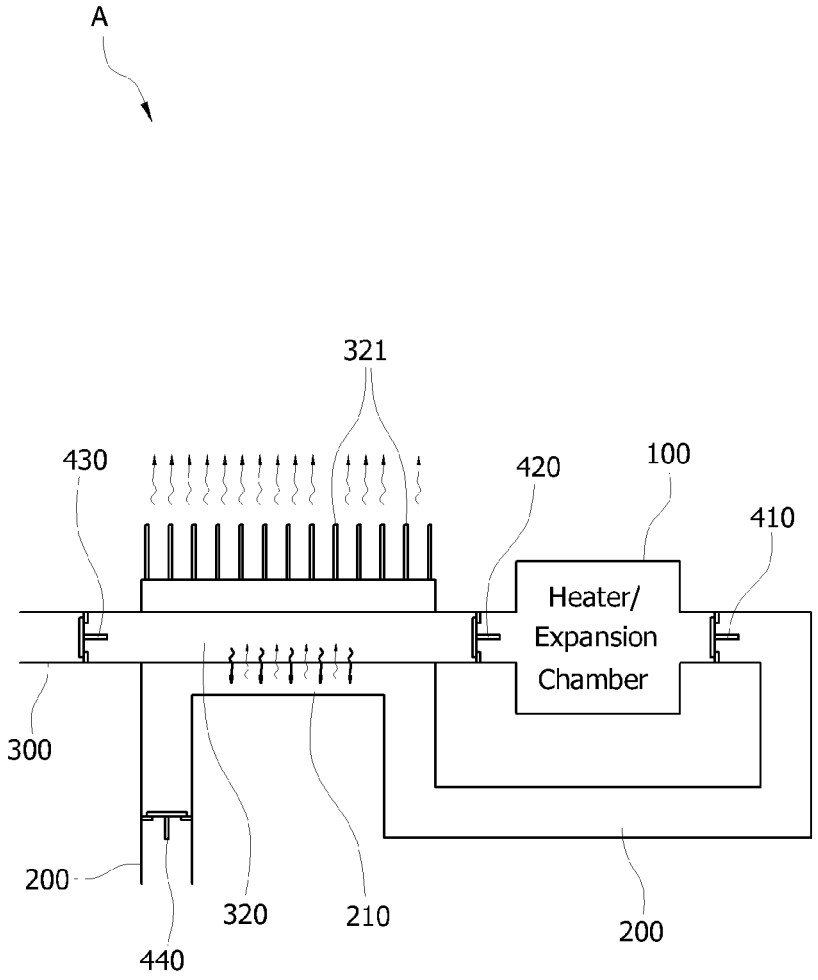
FIG. 5 is a view showing the construction of an embodiment of the gas compressor using the autonomous induction heat exchange method according to the present invention.
Figure 6:
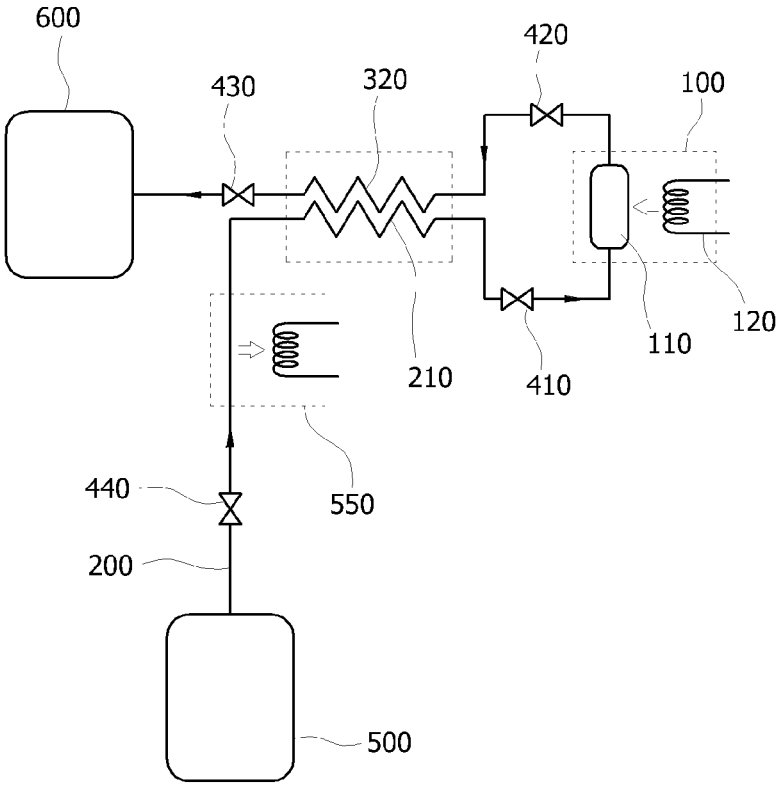
FIG. 6 is a view illustrating a detailed embodiment of the gas compressor having the construction of FIG. 5.

FIG. 5 is a view showing the construction of an embodiment of the gas compressor using the autonomous induction heat exchange method according to the present invention. FIG. 6 is a view illustrating a detailed embodiment of the gas compressor having the construction of FIG. 5. In detail, FIG. 6 shows a gas compressor compressing low-temperature and low-pressure gas supplied from the gas reservoir 500 and storing the compressed low-temperature and high-pressure gas in a compressed gas storage tank 600.

Referring to FIG. 5, the gas compressor A according to the present invention includes a heating chamber 100, an intake pipe 200 and a supply pipe 300.

The heating chamber 100 supplies heat energy to low-temperature gas and produces high-temperature and high-pressure gas, thus making the internal space thereof enter a high-pressure state. Thereafter, the heating chamber 100 discharges the high-temperature and high-pressure gas and converts the internal space thereof into a low-pressure state. That is, the heating chamber 100 heats low-temperature and low-pressure gas supplied from the outside and converts it into high-temperature and high-pressure gas before supplying it to the supply pipe 300.

The intake pipe 200 functions to draw low-temperature gas supplied from the outside into the heating chamber 100 in an autonomous induction manner using a pressure difference while the space in the heating chamber 110 is in a low-pressure state.

The supply pipe 300 functions to supply high-temperature and high-pressure gas produced in the heating chamber 110 to the outside (for example, a high-pressure tank) in an autonomous induction manner using a pressure difference while the space in the heating chamber 110 is in a high-pressure state.

In other words, if gas in the heating chamber 100 is converted into high-temperature and high-pressure gas by heating, it is supplied to the supply pipe 300 and then the pressure in the heating chamber 100 is reduced. When the pressure in the heating chamber 100 is reduced, low-temperature gas is supplied to the heating chamber 100 through the intake pipe 200.

As shown in FIG. 5, in the gas compressor A according to the present invention, heat is exchanged between a first heat exchange part 210 formed in at least a portion of the intake pipe 200 and a second heat exchange part 320 formed on at least a portion of the supply pipe 300.

During the above heat exchange process, high-temperature and high-pressure gas that has been moved from the heating chamber 100 to the supply pipe 300 is reduced in temperature, and low-temperature gas supplied from the outside is increased in temperature and then supplied into the heating chamber 100.

A plurality of heat dissipation fins 321 are provided on the first heat exchange part 210 so that heat transferred from the second heat exchange part 320 is dissipated to the outside through the heat dissipation fins 321. The temperature of high-temperature and high-pressure gas moved to the supply pipe 300 can be rapidly reduced via the heat energy being dissipated to the outside through the heat dissipation fins 321.

Furthermore, the volume of gas in the first heat exchange part 210 is reduced by the degree of reduction in temperature. As the volume of gas is reduced, the pressure of the gas is also reduced. As a result, the intake valve 440 opens, whereby external gas is drawn into the first heat exchange part 210.

As shown in FIG. 5, the gas compressor A according to the present invention further includes a first valve 410 provided between the heating chamber 100 and the intake pipe 200, and a second valve 420 provided between the heating chamber 100 and the supply pipe 300.

The first valve 410 and the second valve 420 are for enhancing the efficiency of the gas compressor A. When the first valve 410 is closed and the second valve 420 is opened, high-temperature and high-pressure gas produced in the heating chamber 100 moves to the second heat exchange part 320 and is able to more efficiently exchange heat with low-temperature gas that remains in the first heat exchange part 210 due to the closed first valve 410.

Subsequently, when the second valve 420 is closed and the first valve 410 is opened, middle-temperature gas that is produced in the first heat exchange part 210 by heat exchange with the high-temperature and high-pressure gas can be rapidly drawn into the heating chamber 100 that has been reduced in pressure.

Furthermore, heat energy required to produce high-temperature and high-pressure gas from middle-temperature gas drawn into the heating chamber 100 can be reduced as much as possible. Therefore, consumption of energy required for the operation of the gas compressor A according to the present invention can be minimized.

In FIG. 5, reference numerals 430 and 440 respectively correspond to the compression valve V3 and the intake valve V4 of FIG. 4, and their methods of operation correspond to that of the description of FIG. 4.

Furthermore, the first heat exchange part 210 and the second heat exchange part 320 of FIG. 5 are configured such that the second heat exchange part 320 passes through the central portion of the first heat exchange part 210 having a cylindrical pipe structure. According to the demand of those skilled in this art, the construction of the first and second heat exchange parts 310 and 320 may be modified in a variety of ways so long as they can conduct heat exchange.

In FIG. 6, reference numeral 550 denotes a cooler. The cooler 550 functions to form negative pressure so that gas stored in the gas reservoir 500 can be rapidly drawn into the intake pipe 200. Reference numeral 110 denotes an expansion chamber, and 120 denotes a heater. Depending on demand of those skilled in this art, the cooler 550 may be disposed around the first heat exchange part 210 or, alternatively, the heat dissipation fins 321 of FIG. 5 may be substituted for the cooler 550. In addition, the cooler 550 may be disposed at an appropriate location so long as negative pressure is formed in the intake pipe 200.

Disposed around or in the expansion chamber 110, the heater 120 receives power and supplies heat to the interior of the expansion chamber 110 in the heat absorption operation S100 to the discharge gas supply operation S300, thus increasing the temperature in the expansion chamber 110.

Thereby, gas increased in temperature and pressure in the expansion chamber 110 can be more rapidly discharged.

Furthermore, the heater 120 may be operated such that in the gas intake operation S500 when the supply of power to the heater 120 is interrupted, the heater 120 no longer supplies heat so that the temperature in the expansion chamber 110 is reduced.

Thereby, in the gas intake operation S500, the pressure in the expansion chamber 110 is reduced whereby the amount (volume) of gas drawn from the first heat exchange part 210 into the expansion chamber 110 can be maximized.

As such, the operation of the heater 120 is controlled according to each operation of the heat exchange method in such a way that a pressure difference between the expansion chamber 110 and any one side of both sides (the intake pipe side and the supply pipe side) of the expansion chamber 110 is maximized. Thereby, a compression ratio of gas can be further increased. Furthermore, the effect of reducing power consumption can be obtained by controlling the supply of power to the heater 120.

FIGS. 7 through 11 are views illustrating other embodiments of the gas compressor having the construction of FIG. 5.

Figure 7:
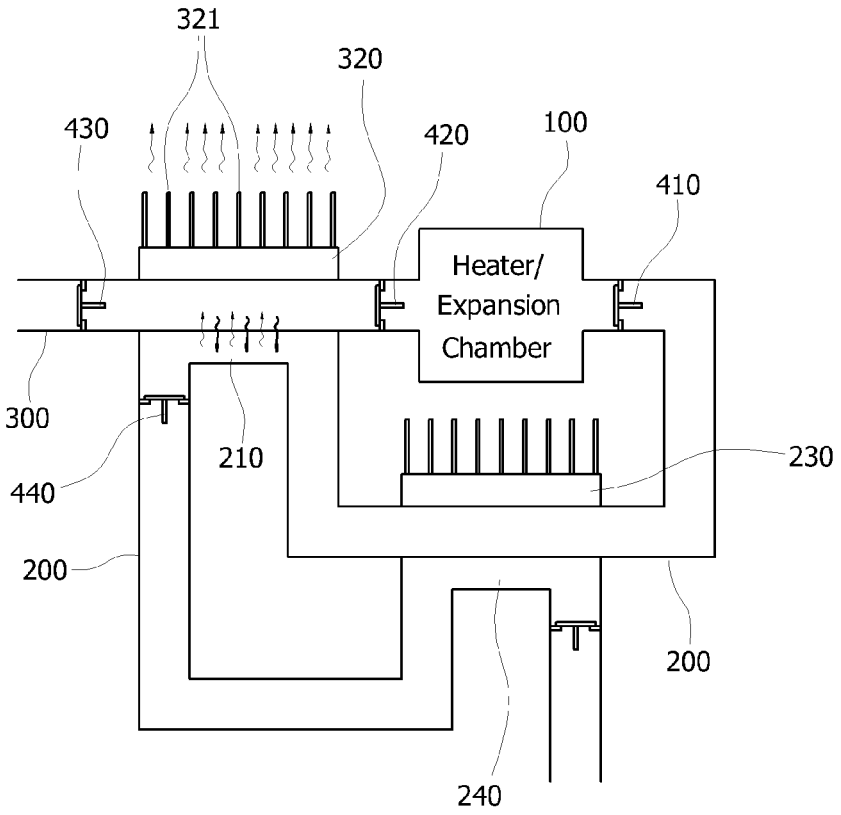
FIGS. 7 through 11 are views illustrating other embodiments of the gas compressor having the construction of FIG. 5.

Referring to FIG. 7, the gas compressor according to an embodiment may be configured such that heat is exchanged between a third heat exchange part 230 formed in at least a portion of the intake pipe 200 between the heating chamber 100 and the first heat exchange part 210 and a fourth heat exchange part 240 formed in at least a portion of the intake pipe 200 extending from the first heat exchange part 210 to the outside.

In other words, the gas compressor may have a multistage heat exchange structure in which a plurality of portions performing heat exchange is present. The multistage heat exchange structure makes heat exchange more efficient. The improvement in the efficiency of heat exchange can further increase the efficiency of compression of the gas compressor A and further reduce consumption of energy.

Although FIG. 7 illustrates a parallel configuration of the multistage heat exchange structure, it may be formed in a series configuration by providing a plurality of first heat exchange parts 210 and a plurality of second heat exchange parts 320.

Figure 8:
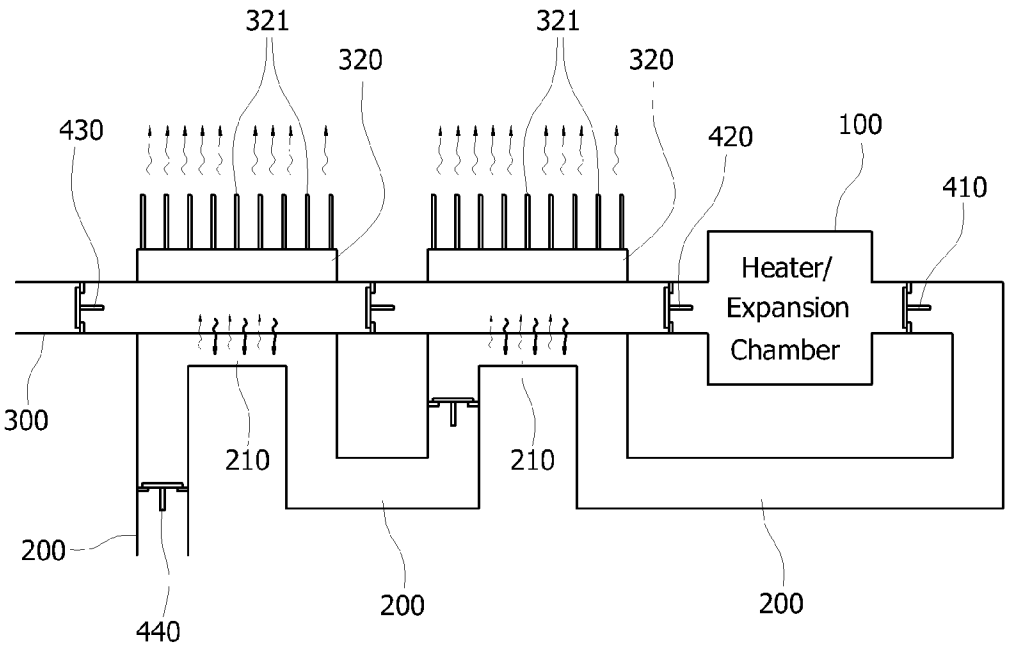
Figure 9:
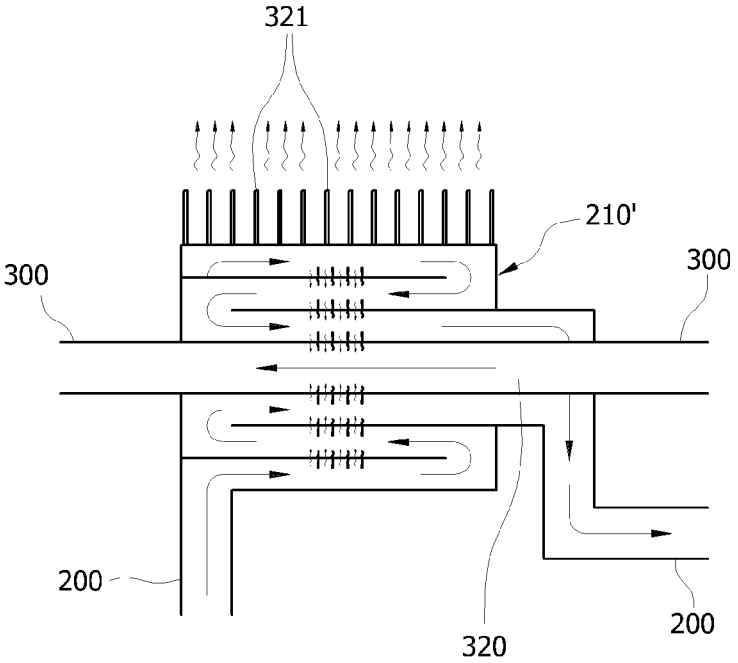

Furthermore, as shown in FIG. 9, at least one of the first heat exchange part 210 and the fourth heat exchange part 240 shown in FIGS. 7 and 8 may form a multiple pipe structure such that gas flows therein in a zigzag manner. In this case, gas flowing through each pipe can exchange heat with gas flowing through adjacent pipes.

Figure 10:
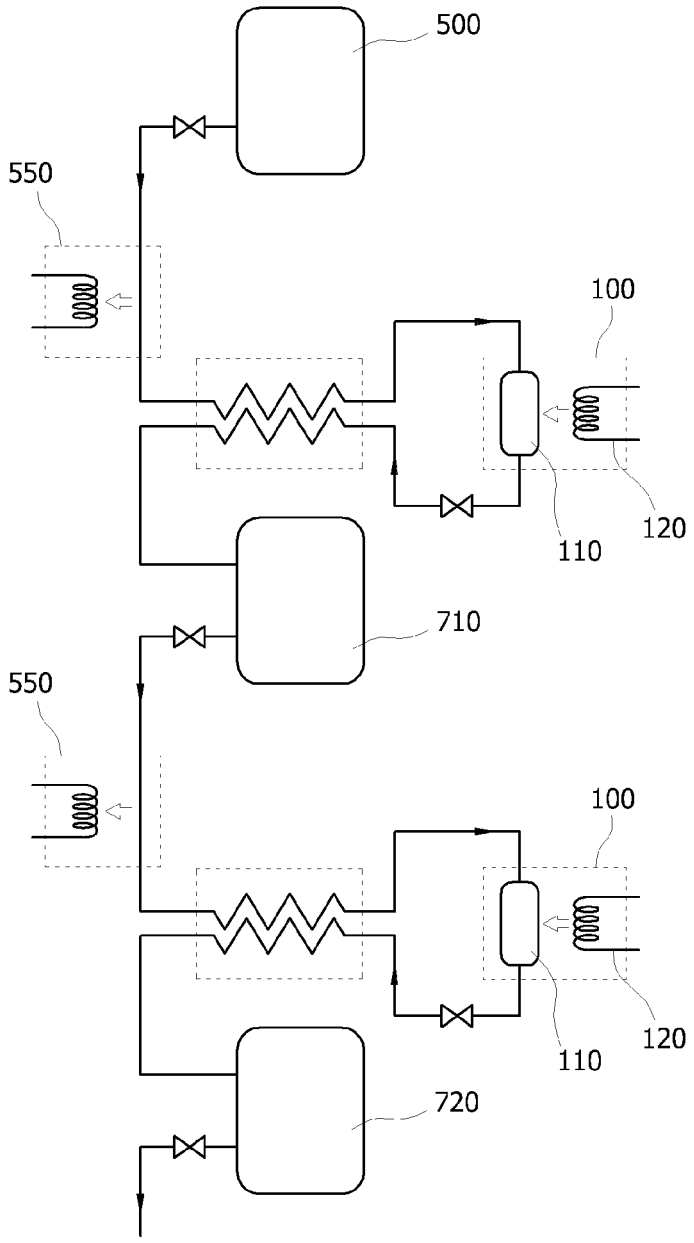

FIG. 10 illustrates the construction of compressing gas in a multistage manner using the gas compressors A of the present invention. Gas drawn from the gas reservoir 500 is compressed by the upper gas compressor A and then supplied to a first compressor 710. Gas discharged from the first compressor 710 is compressed again by the lower gas compressor A and then supplied to a second compressor 720 before being supplied to the compressed gas storage tank 600 shown in FIG. 6.

As shown in FIG. 10, if gas is compressed in a multistage manner, satisfactory gas compression efficiency can be obtained despite reduced heat energy consumption.

Therefore, although natural energy such as solar heat or geothermal heat is used, enough pressure to compress gas can be output. As a result, the energy efficiency can be maximized, and the environment-friendly qualities can be enhanced.

Figure 11:
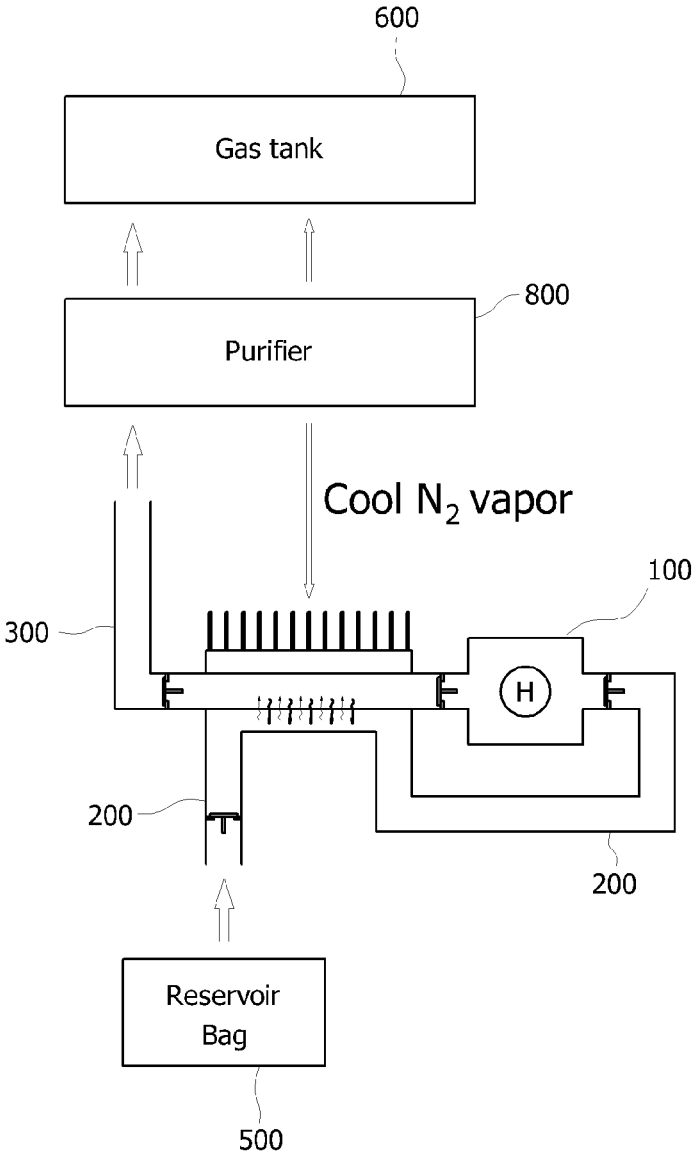

As shown in FIG. 11, if an ultra-low-temperature cooling purifier 800 is used, a gas compression rate can be enhanced even without a separate heat source.

The cooling purifier 800 is used to collect high purity gas. When the temperature of gas compressed by the gas compressor A is lowered to an ultra low temperature using liquefied nitrogen gas, unexpected kinds of gases contained in gas are liquefied. In this way, high purity gas can be collected.

Furthermore, the pressure of gas stored in the compressed gas storage tank 600 can be further increased because the desired kind of gas is changed into an ultra low temperature phase. When ultra low temperature vapor of the cooling purifier 800 is supplied to the heat exchange part of the gas compressor A, gas drawn from the gas reservoir 500 enters a relatively high-temperature state. Therefore, the intended function of the gas compressor A according to the present invention can be conducted using atmospheric heat even without using a heater in the heating chamber 100.

Figure 12:
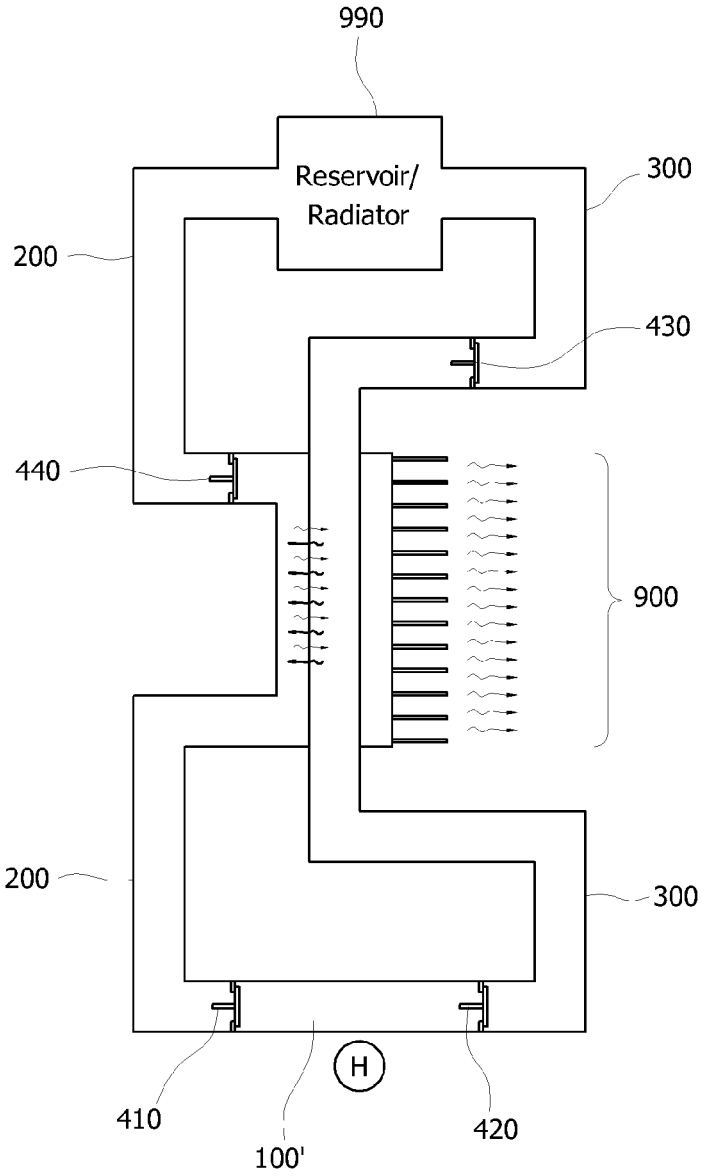
FIG. 12 is a view showing the construction of an embodiment of a heat pump using the autonomous induction heat exchange method of FIG. 3.
Figure 13:
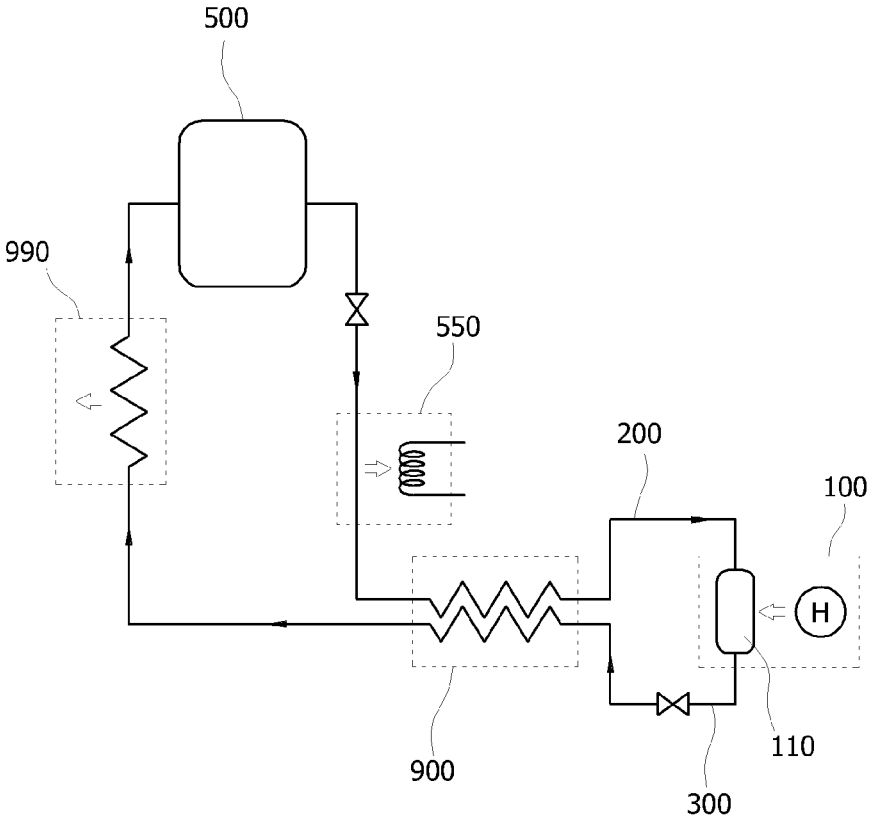
FIG. 13 is a view showing the construction of a detailed embodiment of the heat pump having the construction of FIG. 12.

FIG. 12 is a view showing the construction of an embodiment of a heat pump using the autonomous induction heat exchange method of FIG. 3. FIG. 13 is a view showing the construction of a detailed embodiment of the heat pump having the construction of FIG. 12.

Referring to FIG. 12, the heat pump according to the present invention includes a heat absorption pipe 100', an intake pipe 200, an exhaust pipe 300, a heat exchange part 900 and a radiator 990.

As shown in FIG. 12, when heat energy discharged from the heat source H is absorbed into the heat absorption pipe 100', refrigerant of the heat absorption pipe 100' absorbs the heat energy and moves toward the radiator 990 through the exhaust pipe 300. Here, the exhaust pipe and the supply pipe of FIG. 5 use the same reference numeral. The reason for this is because only the function of the related construction is changed depending on which one of the gas compressor or the heat pump that it belongs to.

High-temperature refrigerant supplied to the radiator 990 through the exhaust pipe 300 is reduced in temperature in the radiator 990 and then moved to the heat absorption pipe 100' through the intake pipe 200. In this way, the refrigerant circulates through the heat pump of FIG. 12.

In other words, although circulating the refrigerant in a close loop circulation manner is similar to that of a heat pipe, there are the following advantages compared to the heat pipe: the structure of the heat absorption pipe 100', etc. can be modified in a variety of ways because an autonomous induction method using a pressure difference is used in circulating the refrigerant; and there are no restrictions in size and shape.

Furthermore, the heat exchange part 900 for conducting heat exchange is formed in at least a portion of the exhaust pipe 300 and at least a portion of the intake pipe 200. Thereby, while flowing through the exhaust pipe 300, the temperature of refrigerant is reduced whereby the pressure thereof is also reduced and thus high-temperature and high-pressure refrigerant in the heat absorption pipe 100' can be easily drawn into the exhaust pipe 300. Furthermore, heat discharge efficiency of the radiator 990 can be enhanced. In addition, thanks to the heat exchange part 900, the temperature of refrigerant flowing through the intake pipe 200 is increased, whereby the pressure thereof is increased. As a result, the refrigerant flowing through the intake pipe 200 can be rapidly moved to the heat absorption pipe 100'. This is the same as the push-pull function described with reference to FIG. 2.

As such, it can be understood that the entire efficiency of the heat pump can be enhanced by the heat exchange part 900 shown in FIG. 12.

Figure 14:
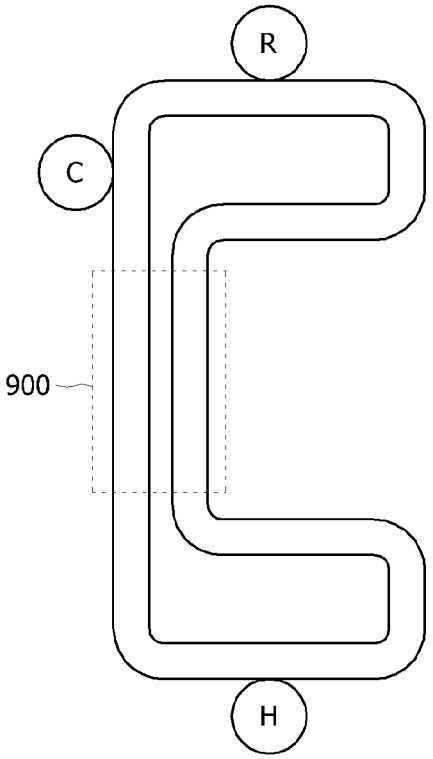
FIG. 14 is a schematic view showing the operation of the heat pump of FIG. 12.
Figure 15:
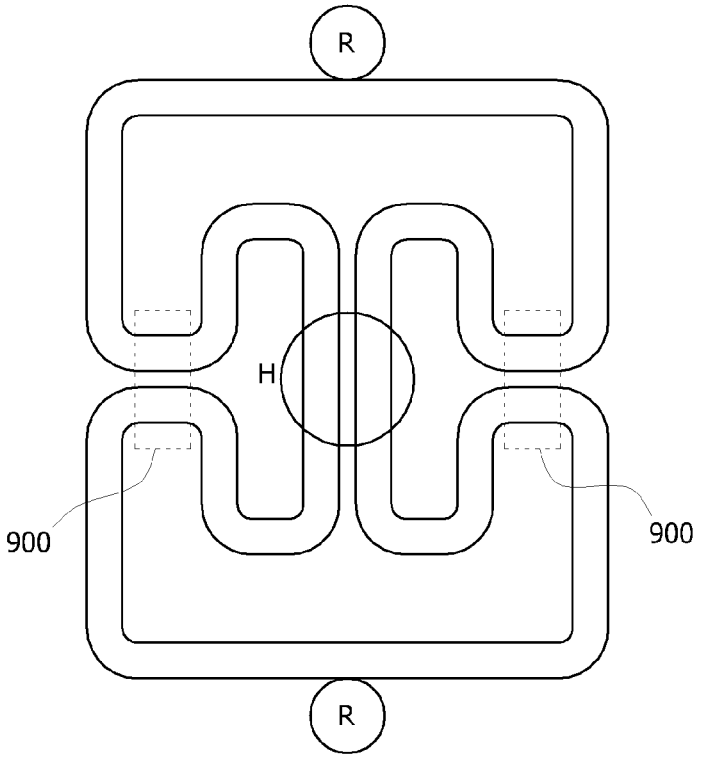
FIGS. 15 through 17 are schematic views showing modifications of the heat pump of FIG. 14.
Figure 16:
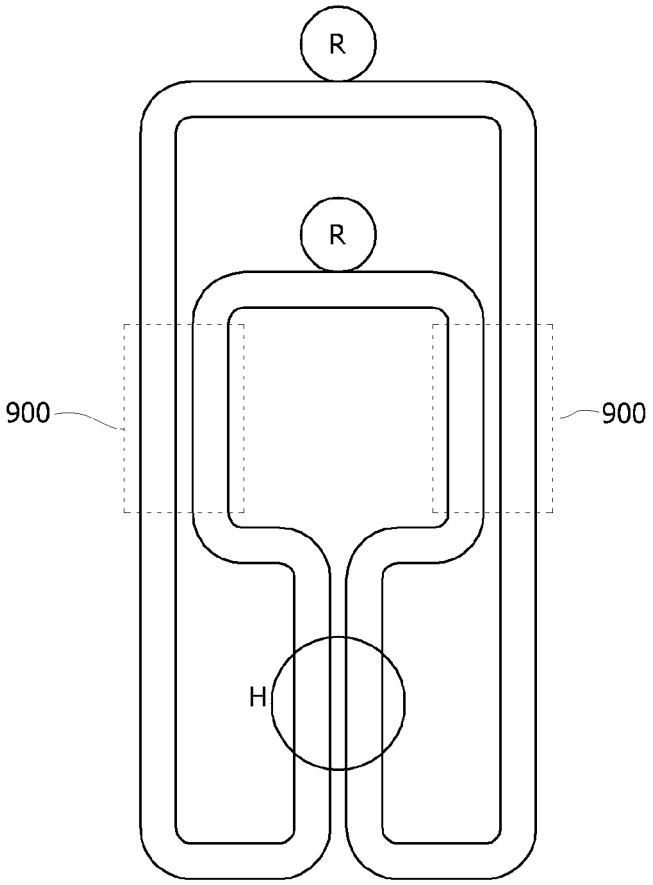
Figure 17:
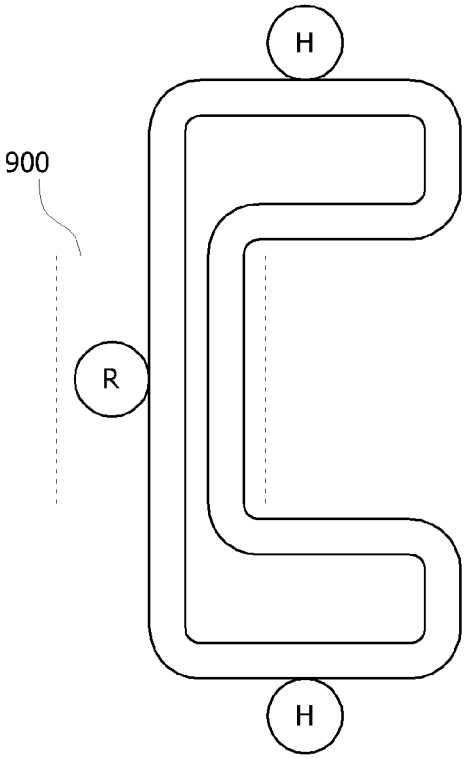

FIG. 14 is a schematic view showing the operation of an embodiment of the heat pump of FIG. 12. FIGS. 15 through 17 are schematic views showing modifications of the heat pump of FIG. 14.

Referring to FIG. 14, the construction of FIG. 12 may include a closed loop pipe, a heat source H, a radiator R, a cooler C and a heat exchange part 900.

Furthermore, as shown in FIGS. 15 and 16, the heat pump structure of FIG. 14 may be configured such that a plurality of heat pumps are integrated into a single structure.

In the structure of FIG. 15, each of the upper and lower portions of the structure based on the heat source H corresponds to the single heat pump structure of FIG. 14. In the structure of FIG. 16, each of the left and right portions of the structure based on the heat source H corresponds to the single heat pump structure of FIG. 14

In detail, heat absorption pipes 100', exhaust pipes 300, intake pipes 200 and heat exchange parts 900, each of which is illustrated in FIG. 12, are provided. The heat absorption pipes 100' are disposed around the heat source H at positions adjacent to each other. The exhaust pipes 300, the intake pipes 200 and heat exchange parts 900 are symmetrically disposed based on the heat source H The heat absorption pipes 100', the exhaust pipes 300, the intake pipes 200 and the heat exchange parts 900 are connected to each other to form a single pipeline.

As such, if, for the single heat source H, the multiple heat pumps are integrated into a single structure, expected heat exchange efficiency can be obtained even when a heat pump having half capacity is used. In other words, heat capacity that can be obtained when the heat pump of FIG. 14 conducts two cycles can be obtained only by one cycle of the heat pump of FIG. 15 or 16.

Compared to the heat pump of FIG. 14, the control can be facilitated because the cycle of operation is reduced to half. Sufficient heat capacity can be obtained although small heat pumps are used.

As shown in FIG. 17, a single heat pump may be used for a plurality of heat sources.

As such, the structure of the heat pump of the present invention can be modified in a variety of ways. Heat exchange can be efficiently conducted for even a plurality of heat sources (or heat sinks).

Figure 18:
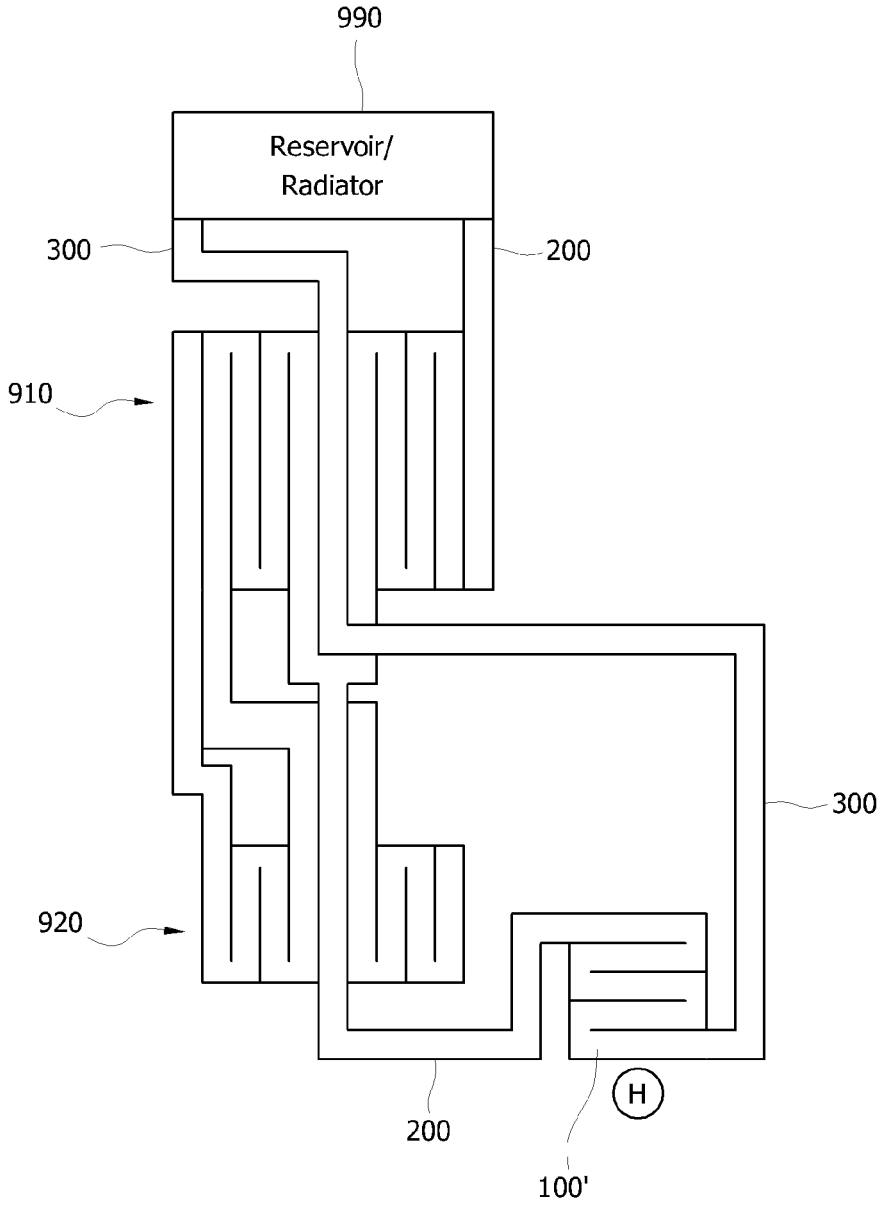
FIG. 18 is a view showing the construction of another embodiment of a heat pump using the autonomous induction heat exchange method of FIG. 3.

FIG. 18 is a view showing the construction of another embodiment of a heat pump using the autonomous induction heat exchange method of FIG. 3. FIGS. 19 through 22 are views illustrating a process of the operation of the heat pump of FIG. 18.

Referring to FIG. 18, the heat exchange part 900 of the heat pump of FIG. 14 may include a first multiple heat exchange pipe 910 and a second multiple heat exchange pipe 920.

As shown in FIG. 18, the first multiple heat exchange pipe 910 has the following multiple pipe structure. In detail, a central portion of the first multiple heat exchange pipe 910 is spatially connected to the exhaust pipe 300 adjacent to the heat absorption pipe 100'. A peripheral portion of the first multiple heat exchange pipe 910 is spatially connected to the intake pipe 200 adjacent to the radiator 990. A space is formed in a zigzag manner between the central portion and the peripheral portion of the first multiple heat exchange pipe 910.

The second multiple heat exchange pipe 920 has a multiple pipe structure equal or similar to that of the first multiple heat exchange pipe 910. A central portion of the second multiple heat exchange pipe 920 is spatially connected to the intake pipe 200 adjacent to the heat absorption pipe 100'. A peripheral portion of the second multiple heat exchange pipe 920 is spatially connected to the first multiple heat exchange pipe 910. A space is formed in a zigzag manner between the central portion and the peripheral portion of the second multiple heat exchange pipe 920.

Figure 19:
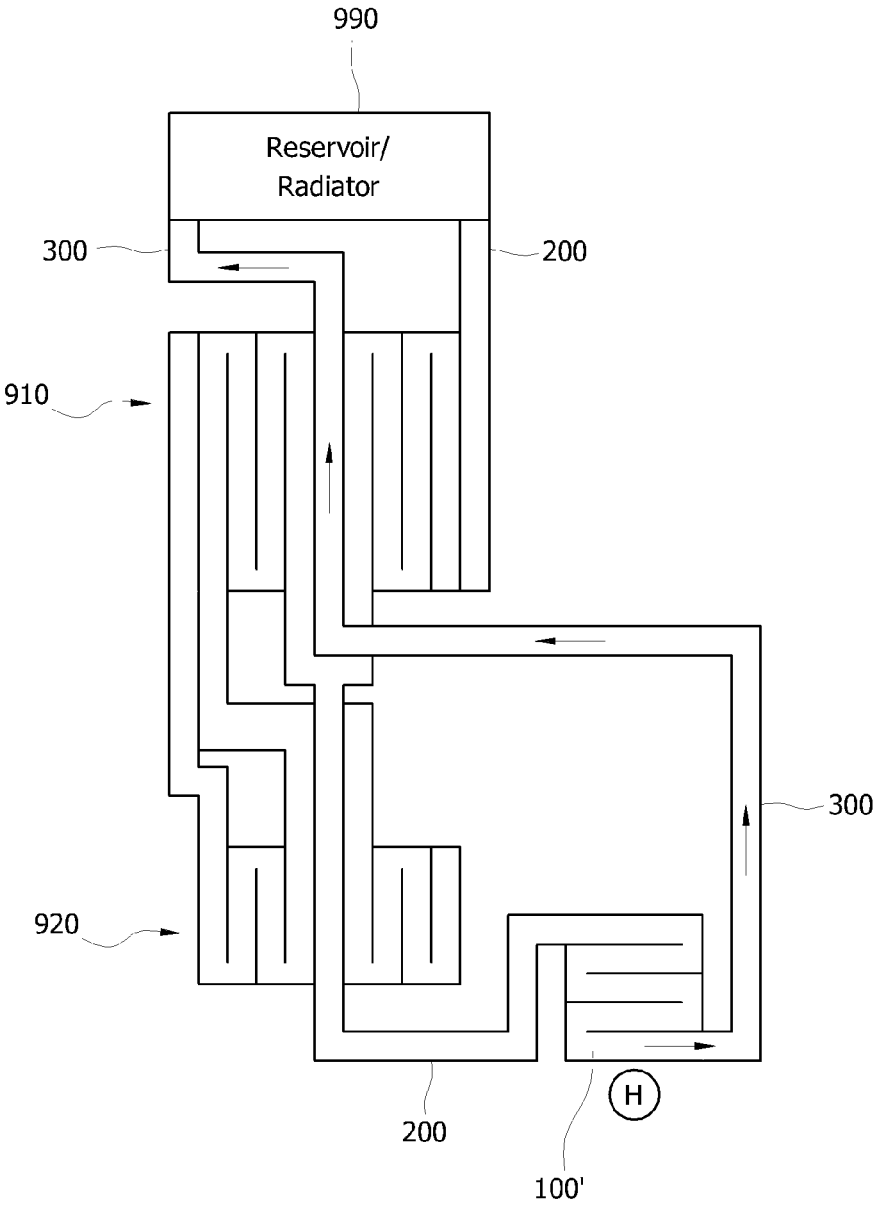
FIGS. 19 through 22 are views illustrating a process of the operation of the heat pump of FIG. 18.

With regard to the operation of the heat pump of this embodiment, as shown in FIG. 19, refrigerant that has absorbed heat energy of the heat source H in the heat absorption pipe 100' is moved to an evaporator 990 via the first multiple heat exchange pipe 910 along the exhaust pipe 300.

Figure 20:
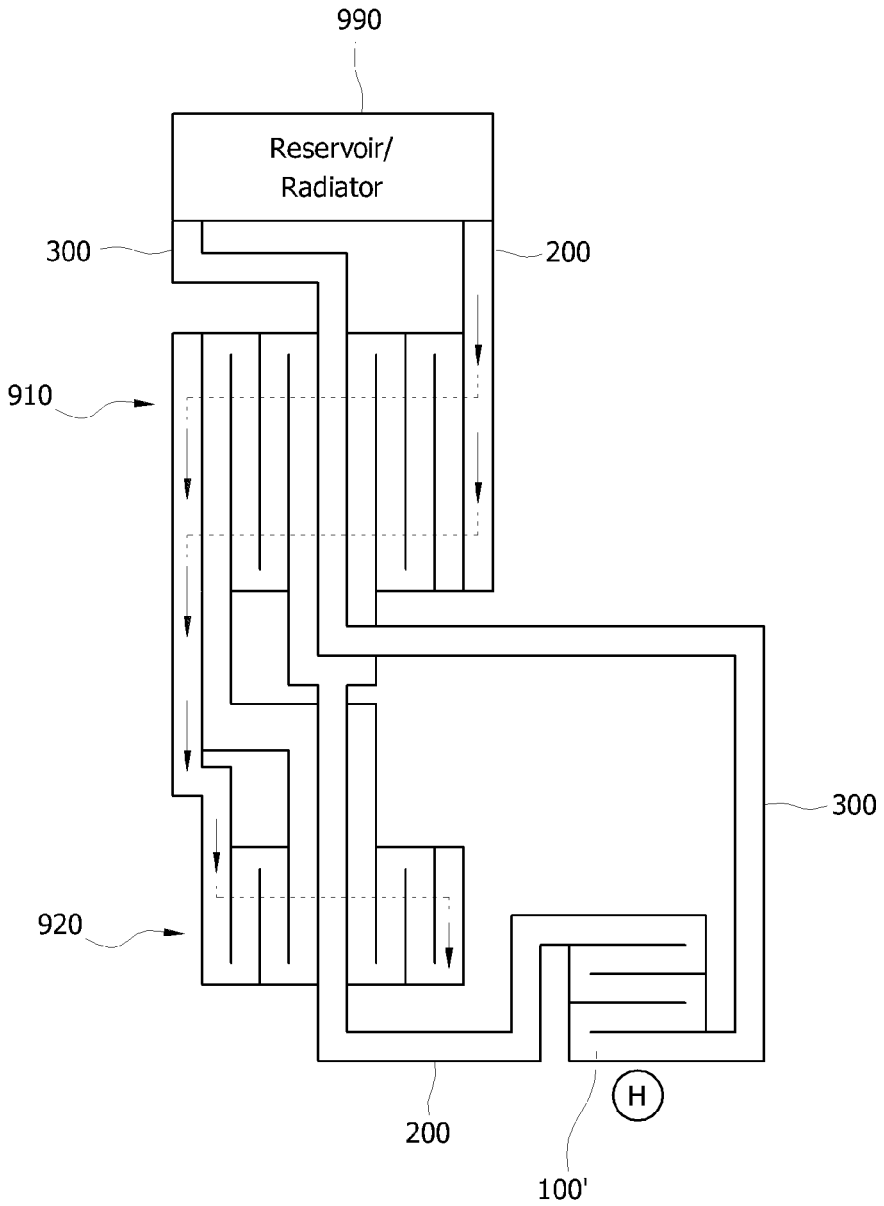

As shown in FIG. 20, refrigerant, the temperature of which has reduced in the evaporator 990, is drawn into the peripheral portion of the second multiple heat exchange pipe 920 through the peripheral portion of the first multiple heat exchange pipe 910.

Figure 21:
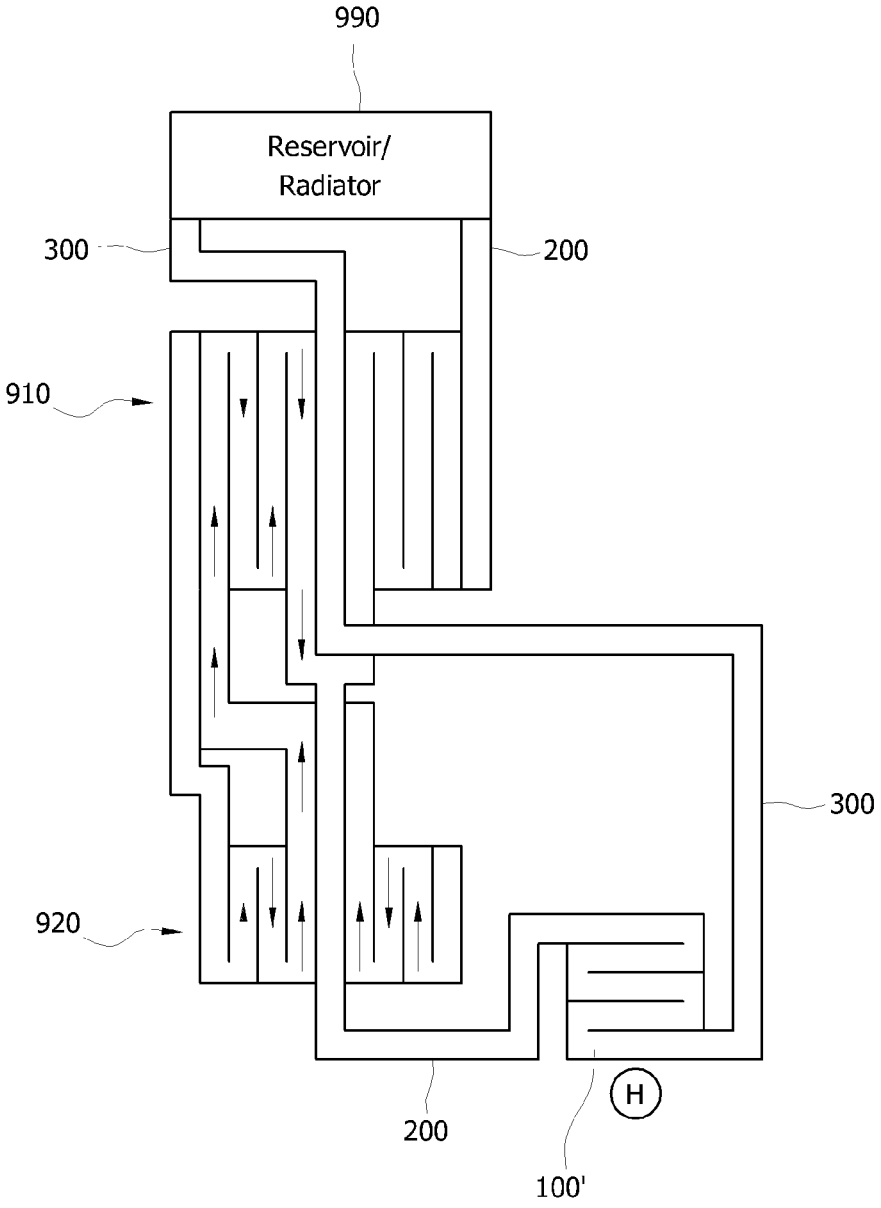
Figure 22:
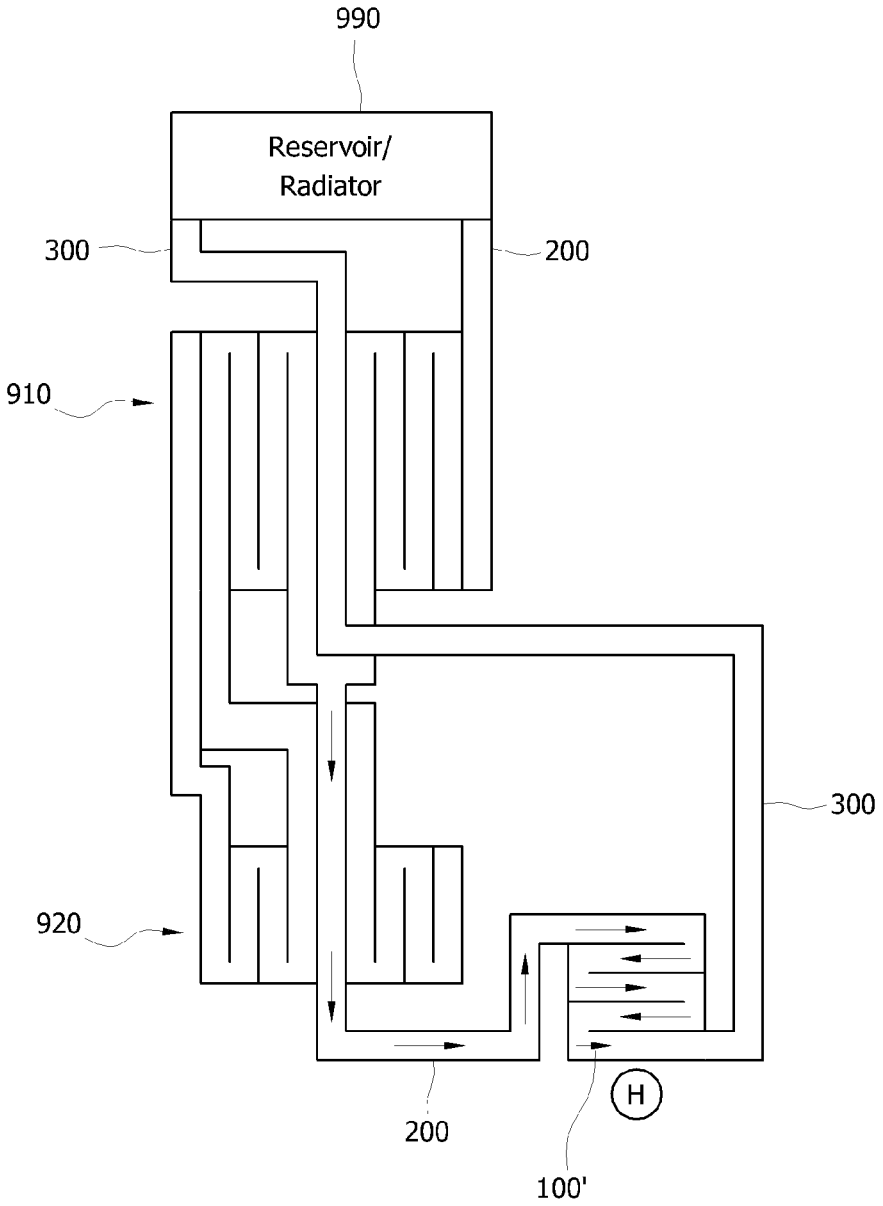

As shown in FIG. 21, refrigerant that has been drawn into the second multiple heat exchange pipe 920 exchanges heat with refrigerant flowing along the adjacent pipes before entering the first multiple heat exchange pipe 910. Thereafter, refrigerant that has entered the first multiple heat exchange pipe 910 exchanges heat with refrigerant flowing along the adjacent pipes.

Subsequently, refrigerant that has passed through the central portion of the second multiple heat exchange pipe 910 is drawn into the heat absorption pipe 100'. In this way, refrigerant is circulated.

Hitherto, an autonomous induction heat exchange method using a pressure difference and a gas compressor, and a heat pump using the same according to the embodiments of the present invention have been illustrated. Those skilled in the art will appreciate that various modifications, additions and substitutions are possible, without departing from the scope and spirit of the invention as disclosed in the accompanying claims.

Therefore, it should be understood that the preferred embodiment is only for illustrative purposes and does not limit the bounds of the present invention. It is intended that the bounds of the present invention are defined by the accompanying claims, and various modifications, additions and substitutions, which can be derived from the meaning, scope and equivalent concepts of the accompanying claims, fall within the bounds of the present invention.

INDUSTRIAL APPLICABILITY

The present invention can be used not only in the compressor field, the field pertaining to compression and storage of natural gas, the field related to collection of high purity gas, the heat exchanger field and the air conditioning field but also in other similar or related fields. The present invention can enhance the reliability and competitiveness of products.

The invention claimed is:

1. An autonomous induction heat exchange method using a pressure difference, comprising:

a heat absorption operation of absorbing heat energy generated from a heat source of a heat source part;

a temperature and pressure increase operation of applying the heat energy of the heat source part to low-temperature gas and producing high-temperature and high-pressure gas;

a discharge gas supply operation of discharging the high-temperature and high-pressure gas using a pressure difference and supplying the high-temperature and high-pressure gas to a compression unit;

a temperature and pressure reduction operation of conducting heat exchange in the compression unit and converting the high-temperature and high-pressure discharge gas into low-temperature and low-pressure discharge gas;

a gas intake operation of drawing suction gas into the heat source part using a pressure difference, the suction gas having been increased in temperature and pressure by heat exchange with the discharge gas in the temperature and pressure reduction operation; and a gas suction operation of suctioning and adding gas of an amount corresponding to a volume reduced by the suction gas drawn into the heat source part.

2. The autonomous induction heat exchange method of claim 1, wherein the low-temperature and low-pressure discharge gas produced in the temperature and pressure reduction operation is drawn as the suction gas into the heat source part through the gas suction operation and the gas intake operation.

3. The autonomous induction heat exchange method of claim 1, further comprising, after the temperature and pressure reduction operation, a gas compression operation of accumulating low-temperature and low-pressure discharge gas that has passed through the heat exchange process in the compression unit and producing low-temperature and high-pressure gas, wherein the gas suction operation comprises suctioning and adding low-temperature gas drawn from the outside.

4. The autonomous induction heat exchange method of claim 1, wherein in the heat absorption operation through the gas supply operation, a suction valve of the heat source part is controlled to be closed, and a discharge valve of the heat source part is controlled to be open, and in the temperature and pressure reduction operation and the gas intake operation, the discharge valve of the heat source part is controlled to be closed, and the suction valve of the heat source part is controlled to be open.

5. The autonomous induction heat exchange method of claim 1, wherein in the heat absorption operation and the temperature and pressure increase operation, the suction valve and the discharge valve of the heat source part are controlled to be closed, in the gas supply operation, the discharge valve of the heat source part is controlled to be open, in the temperature and pressure reduction operation, the discharge valve of the heat source part is controlled to be closed, and in the gas intake operation, the suction valve of the heat source part is controlled to be open.

6. The autonomous induction heat exchange method of claim 1, wherein in at least one of the heat absorption operation and the discharge gas supply operation, a heater is operated to supply heat to the heat source part, and in the gas intake operation, the operation of the heater is interrupted.

7. A gas compressor using an autonomous induction heat exchange method using a pressure difference, the gas compressor comprising:

a heating chamber supplying heat energy to low-temperature gas and producing high-temperature and high-pressure gas whereby an interior of the heating chamber enters a high-pressure state, wherein when the heating chamber discharges the high-temperature and high-pressure, the interior of the heating chamber enters a low-pressure state;

an intake pipe drawing the low-temperature gas into the heating chamber in an autonomous induction manner using a pressure difference while the interior of the heating chamber is in the low-pressure state; and a supply pipe supplying high-temperature and high-pressure gas produced in the heating chamber to the outside in an autonomous induction manner using a pressure difference while the interior of the heating chamber is in the high-pressure state, wherein heat is exchanged between a first heat exchange part formed in at least a portion of the intake pipe and a second heat exchange part formed on at least a portion of the supply pipe.

8. The gas compressor of claim 7, further comprising a cooler provided in a predetermined portion of the first heat exchange part, the cooler cooling an interior of the first heat exchange part, wherein when the first heat exchange part enters a positive pressure state and the second heat exchange part enters a negative pressure state by heat exchange between the first heat exchange part and the second heat exchange part, gas in the first heat exchange part is drawn into the heating chamber by a pressure difference between both ends of the heating chamber, when the gas in the first heat exchange part is drawn into the heating chamber, the cooler is operated to cool the interior of the first heat exchange part, and when the interior of the first heat exchange part is cooled and enters a negative pressure state, external gas is drawn into the first heat exchange part.

9. The gas compressor of claim 7, further comprising:

a first valve provided between the heating chamber and the intake pipe; and a second valve provided between the heating chamber and the supply pipe, wherein when the first valve is closed and the second valve is opened so that the high-temperature and high-pressure gas produced in the heating chamber is moved to the second heat exchange part, heat is exchanged between low-temperature gas remaining in the first heat exchange part and the high-temperature and high-pressure gas.

10. The gas compressor of claim 9, wherein when the second valve is closed and the first valve is opened, middle-temperature gas produced by heat exchange between the low-temperature gas and the high-temperature and high-pressure gas in the first heat exchange part is drawn into the heating chamber.

11. The gas compressor of claim 10, further comprising a cooler provided in a predetermined portion of the first heat exchange part, the cooler cooling an interior of the first heat exchange part, wherein when the middle-temperature gas is drawn into the heating chamber, the cooler is operated to cool the interior of the first heat exchange part, and during a time for which external gas of an amount corresponding to an amount of gas drawn into the heating chamber is charged into the first heat exchange part, the first valve and the second valve are maintained in a closed state.

12. The gas compressor of claim 7, wherein heat is exchanged between a third heat exchange part formed in at least a portion of the intake pipe between the heating chamber and the first heat exchange part and a fourth heat exchange part formed in at least a portion of the intake pipe extending from the first heat exchange part to the outside.

13. The gas compressor of claim 12, wherein at least one of the first heat exchange part and the fourth heat exchange part forms a multiple pipe structure such that gas flows therein in a zigzag manner.

14. The gas compressor of claim 7, wherein the first heat exchange part and the second heat exchange part respectively comprise a plurality of first heat exchange parts and a plurality of second heat exchange parts.

15. The gas compressor of claim 14, wherein at least one of the first heat exchange parts forms a multiple pipe structure such that gas flows therein in a zigzag manner.

16. A heat pump using an autonomous induction heat exchange method using a pressure difference, the heat pump comprising:

a heat absorption pipe absorbing heat energy from a heat source;

an exhaust pipe through which refrigerant absorbing heat energy in the heat absorption pipe is moved to a radiator in an autonomous induction manner by a difference between a heat absorption pipe side pressure and a radiator side pressure;

an intake pipe through which refrigerant cooled by discharge of heat energy from the radiator is drawn into the heat absorption pipe in an autonomous induction manner by a difference between a radiator side pressure and a heat absorption pipe side pressure; and a heat exchange part formed in at least a portion of the exhaust pipe and the intake pipe, the heat exchange part conducting heat exchange.

17. The heat pump of claim 16, wherein the heat exchange part comprises:

a first multiple heat exchange pipe having a multiple pipe structure such that: a central portion thereof is spatially connected to a portion of the exhaust pipe adjacent to the heat absorption pipe; a peripheral portion thereof is spatially connected to a portion of the intake pipe adjacent to the radiator; and a space is formed in a zigzag manner between the central portion and the peripheral portion of the first multiple heat exchange pipe; and a second multiple heat exchange pipe having a multiple pipe structure such that: a central portion thereof is spatially connected to a portion of the intake pipe adjacent to the heat absorption pipe; a peripheral portion thereof is spatially connected to the first multiple heat exchange pipe; and a space is formed in a zigzag manner between the central portion and the peripheral portion of the second multiple heat exchange pipe, wherein refrigerant cooled in the radiator flows into the peripheral portion of the second multiple heat exchange pipe via the peripheral portion of the first multiple heat exchange pipe, flows into the first multiple heat exchange pipe after passing through a heat exchange process in the second multiple heat exchange pipe, and then flows into the heat absorption pipe via the central portion of the second multiple heat exchange pipe after passing through a heat exchange process in the first multiple heat exchange pipe.

18. The heat pump of claim 16, wherein the heat absorption pipe, the exhaust pipe, the intake pipe and the heat exchange part respectively comprise a plurality of heat absorption pipes, a plurality of exhaust pipes, a plurality of intake pipes and a plurality of heat exchange parts, the heat absorption pipes are disposed around the heat source at positions adjacent to each other, the exhaust pipes, the intake pipes and the heat exchange parts are symmetrically arranged around the heat source, and the heat absorption pipes, the exhaust pipes, the intake pipes and the heat exchange parts are connected to each other to form a single pipeline.

* * * * *